United States Patent [19]

Das

[11] 4,308,113

[45] Dec. 29, 1981

[54] PROCESS FOR PRODUCING ALUMINUM USING GRAPHITE ELECTRODES HAVING REDUCED WEAR RATES

[75] Inventor: Subodh K. Das, Apollo, Pa.

[73] Assignee: Aluminum Company of America, Pittsburgh, Pa.

[21] Appl. No.: 170,637

[22] Filed: Jul. 21, 1980

[51] Int. Cl.[3] ..... C25C 3/06; C25C 7/02

[52] U.S. Cl. ..... 204/67; 204/294

[58] Field of Search ..... 204/67, 294, 243 R

[56] References Cited

U.S. PATENT DOCUMENTS 2,997,744 8/1961 Stoddard et al. ..... 204/294

3,400,061 9/1968 Lewis et al. ..... 204/67

3,755,099 8/1973 Haupin ..... 204/67

*Primary Examiner*—Howard S. Williams

*Attorney, Agent, or Firm*—Carl R. Lippert

[57] ABSTRACT

In the production of a metal such as aluminum by electrolysis of an electrolyte bath containing a compound of the metal dissolved therein to produce the metal at a graphite cathode surface, the wear rate of the graphite cathode surface is significantly reduced by incorporating therein selected amounts of certain compounds of aluminum or titanium, especially $Al_2O_3$ and $TiO_2$. The improvement is particularly suited to the production of aluminum from chloroaluminate electrolyte baths.

12 Claims, 1 Drawing Figure

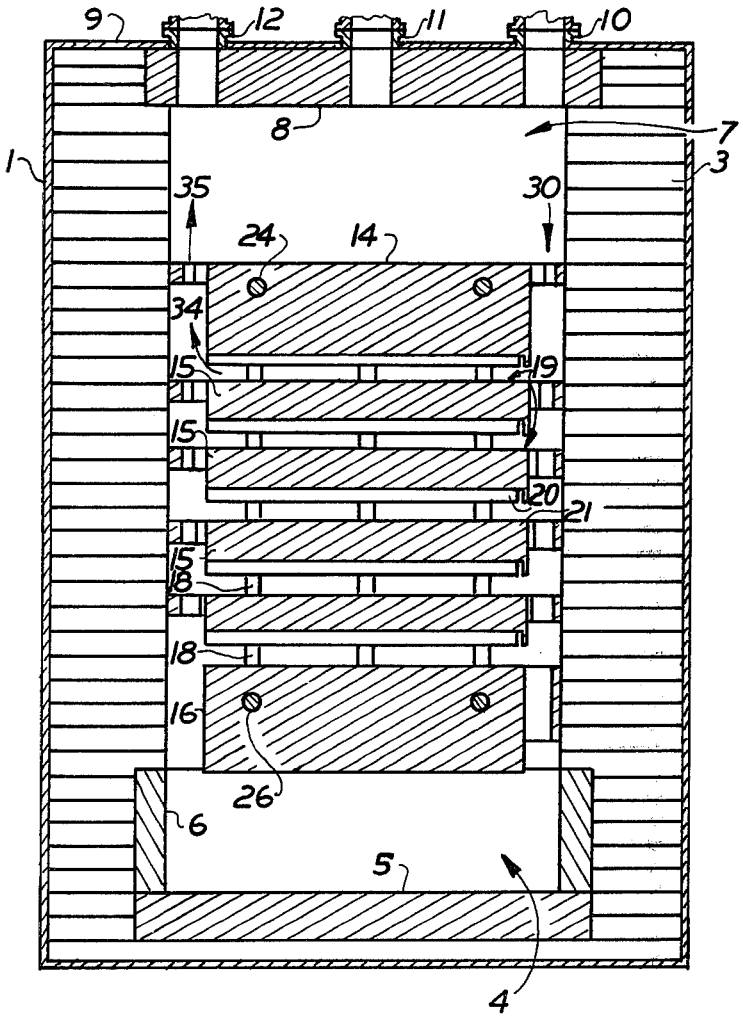
9
12
11
10
8
7
1
3
35
30
24
14
34
15
19
15
20
21
15
18
18
16
26
6
5
4

PROCESS FOR PRODUCING ALUMINUM USING GRAPHITE ELECTRODES HAVING REDUCED WEAR RATES

BACKGROUND OF THE INVENTION

This invention relates to the production of metal such as aluminum from a metal chloride or other compound of the metal dissolved in molten solvent bath by electrolyzing the bath in a monopolar or bipolar electrolysis cell. More particularly, the invention relates to graphite electrodes used in such cells and to reducing their wear characteristics so as to prolong useful electrode life in such cells and to controlled methods of graphite electrode manufacture to achieve such reduced wear rates.

One type of electrolytic cell used in the production of metal, such as aluminum, from metal chloride dissolved in a solvent salt bath includes a terminal anode, at least one intermediate bipolar electrode and a terminal cathode. These electrodes are typically situated in relatively closely spaced, generally parallel relationship wherein opposed anode-cathode faces provide interelectrode spaces through which the molten bath can move and be electrolyzed by passage of current from anode to cathode. Electrolysis of the metal chloride occurring within the interelectrode space results in molten metal depositing at the cathode and chlorine gas collecting at the anode. Cells of this type are described in U.S. Pat. Nos. 3,755,099, 3,822,195 and 4,179,345, incorporated herein by reference. One of the important features of these cells is that the anode-to-cathode space or distance should be carefully maintained at a preselected level in order to achieve the lower power consumption capabilities of the bipolar chloride electrolysis process. Any amount of wear occurring on either the anode or the cathode surface, as by erosion or other removal of electrode material, tends to increase the distance and, accordingly, increase the electrical resistance across the distance between anode and cathode. For the most part, the anode presents little problem since under most conditions chlorine is relatively non-corrosive to the carbonaceous materials employed for anodes. However, experience has shown that some amount of electrode wear does occur on the cathode surface, and considerable effort has been expended for reducing or relieving this wear condition. Excessive cathode surface wear is a problem, not only respecting increased power consumption as just explained, but there is the further possibility of increasing the resistance so much that the cell is considered uneconomical to operate, thus necessitating a costly shutdown, repair or replacement of the electrodes, and restarting the cell. In addition to the electrical resistance problems resulting from cathode wear, the carbonaceous material removed from the cathode surface can contaminate the bath. This alone can reach such an extreme as to necessitate shutting down the cell.

SUMMARY OF THE INVENTION

In accordance with the invention, it has been discovered that the life of graphite electrodes, especially cathode surfaces in aluminum chloride electrolysis cells, is sensitive to the ash content of the graphite and that adding compounds of aluminum or titanium to the coke used in producing graphite extends the life of graphite cathode electrodes provided the graphitizing temperature is controlled to the low side of the graphitizing range. The invention is particularly suited to production of wettable graphites produced employing relatively low graphitizing temperatures, as described in U.S. Pat. Nos. 4,179,345 and 4,179,346 incorporated herein by reference.

Accordingly, it is an object of the present invention to provide for decreased cathode electrode wear in electrolytic cells used in producing metal, such as aluminum, from metal compounds such as halides or chlorides.

Another object is to provide for reduced graphite cathode wear rates by controlling the ash content thereof.

Another object is to provide for reduced cathode wear rates in graphite produced from coke and graphitized at relatively low graphitizing temperatures by controlling the ash content of the carbonaceous material employed in producing the graphite.

Another object is to improve the wear rate of wettable graphite used in producing aluminum by electrolyzing aluminum chloride, the improvement residing in controlling the ash content of such wettable graphite cathodes.

These and other objects will be apparent from the drawing, specification and claims appended hereto.

In accordance with the invention, it has been found that graphite cathode surface wear is significantly reduced if the ash content is controlled by adding compounds of titanium or aluminum, or both, which are solid and substantially stable at electrolysis operating temperatures. Preferred compounds are the oxides of Ti and Al, especially $TiO_2$ and $Al_2O_3$. It is also important that the graphitizing temperature employed in converting the carbonaceous raw materials into the graphite structure be in the range of 2000° or 2100° C. up to 2300° or 2400° C. One preferred embodiment of the invention is to utilize the improvement in producing wettable electrodes in accordance with the teachings of U.S. Pat. Nos. 4,179,346 and 4,179,345 mentioned above which disclose the use of relatively low graphitizing temperatures to produce wettable graphite for use in those regions of aluminum chloride electrolysis cells where the bath velocity between oppositely acing anode and cathode surfaces is 1-½ feet per second or less or the spacing between said opposed electrode surfaces is greater than ½ inch. As indicated in said patents, such conditions often occur in the lower regions or regions closer to the terminal cathode in such cells.

BRIEF DESCRIPTION OF THE DRAWINGS

FIG. 1 is a schematic sectional elevation illustrative of a cell useful in producing aluminum or other metal in accordance with the invention.

DETAILED DESCRIPTION OF THE INVENTION

A suitable cell structure for producing metal in accordance with the invention is illustrated in FIG. 1. The cell there shown is a multiple bipolar electrode cell useful in producing aluminum by electrolyzing aluminum chloride. The cell illustrated includes an outer steel shell 1, which is lined with refractory sidewall and end wall brick 3, made of thermally insulating, electrically non-conductive material which is resistant to molten alkali metal and metal chloride-containing halide bath and the decomposition products thereof. The cell cavity includes a sump 4 in the lower portion for collecting the metal produced. The sump bottom 5 and walls 6 are preferably made of graphite. The cell cavity also accommodates a bath reservoir 7 in its upper zone. The cell is enclosed by a refractory roof 8, and a lid 9. A first port 10, extending through the lid 9 and roof 8, provides for insertion of a vacuum tapping tube down into sump 4, through an internal passage to be described later, for removing molten metal from the sump. A second port 11 provides inlet means for feeding the metal chloride into the bath. A third port 12 provides outlet means for venting chlorine.

Within the cell cavity are a plurality of plate-like electrodes which include an upper terminal anode 14, desirably an appreciable number of bipolar electrodes 15 (four being shown), and a lower terminal cathode 16, all of graphite. These electrodes are shown arranged in superimposed relation, with each electrode preferably being horizontally disposed within a vertical stack. Sloping or vertically disposed electrodes can also be employed, however, in either monopolar or bipolar electrode cell arrangements. In FIG. 1, the cathode 16 is supported at each end on sump walls 6. The remaining electrodes are stacked one above the other in a spaced relationship established by interposed refractory pillars 18. Such pillars 18 are sized to space the electrodes relatively close, as for example to space them with their opposed surfaces separated by ¾ inch or less. In the illustrated embodiment, five interelectrode spaces 19 are provided between opposed electrodes, one between terminal cathode 16 and the lowest of the bipolar electrodes 15, three between successive pairs of intermediate bipolar electrodes 15, and one between the highest of the bipolar electrodes 15 and terminal anode 14. Each interelectrode space 19 is bounded by an upper surface 20 provided by the bottom of one electrode (which surface 20 functions as an anode surface) opposite a lower surface 21 provided by the top of another electrode (which surface 21 functions as a cathode surface). The spacing between anode and cathode surfaces is the anode-cathode distance in the absence of a metal layer of substantial thickness. When a layer of metal is present on the cathode surface, the effective anode-cathode distance is shorter by the depth of the metal layer than the distance between the graphite electrode surfaces 20 and 21. The bath level in the cell will vary in operation but normally will lie well above the anode 14, thus filling all otherwise unoccupied space therebelow within the cell.

Terminal anode 14 has a plurality of electrode bars 24 inserted therein which serve as positive current leads, and terminal cathode 16 has a plurality of collector bars 26 inserted therein which serve as negative current leads. The bars 24 and 26 extend through the cell wall and are suitably insulated from the steel shell 1. A suitable voltage is imposed across the terminal anode 14 and the terminal cathode 16, and this imparts the bipolar character to bipolar electrodes 15.

As indicated earlier, the sump 4 is adapted to contain bath and metal, and the latter may accumulate beneath the bath in the sump, during operation. Should it be desired to separately heat the bath and any metal in sump 4, an auxiliary heating circuit, now shown, may be established therein.

A bath supply passage indicated by arrow 30 generally extends from the upper reservoir 7 down along the right-hand side (as viewed in FIG. 1) of the electrodes and into each interelectrode space 19. Thus, each of the interelectrode spaces 19 is supplied with a continual supply of the molten bath which travels across each interelectrode space 19 (moving right to left in FIG. 1) and exits the interelectrode space 19 turning upwardly as generally indicated by arrows 34 and 35.

The electrolyte employed for producing aluminum in accordance with the present invention typically comprises a molten salt bath composed essentially of aluminum chloride dissolved in one or more halides, particularly chlorides, of higher decomposition potential than aluminum chloride. By electrolysis of such a bath, chlorine is produced on the anode surfaces and aluminum on the cathode surfaces of the cell electrodes. The metal is conveniently separated by settling from the lighter bath, and the chlorine rises to be vented from the cell. In such practice of the present invention, the molten bath may be positively circulated through the cell by the buoyant gas lift effect of the internally produced chlorine gas, and aluminum chloride is periodically or continuously introduced into the bath to maintain the desired concentration thereof.

The bath composition, in addition to the dissolved aluminum chloride, will usually be made up of alkali metal chloride, although, other alkali metal halide and alkaline earth halide may also be employed. A preferred aluminum chloride containing composition comprises an alkali metal chloride base composition made up of about 50–75% by weight sodium chloride and 25–50% lithium chloride. Aluminum chloride is dissolved in such halide composition to provide a bath from which aluminum may be produced by electrolysis, and an aluminum chloride content of about 1-½ to 10% by weight of the bath is generally desirable. As an example, a bath analysis as follows (in percent by weight) is satisfactory: 53% NaCl, 40% LiCl, 0.5% $MgCl_2$, 0.5% KCl, 1% $CaCl_2$ and 5% $AlCl_3$. In such bath, the chlorides other than NaCl, LiCl and $AlCl_3$ may be regarded as incidental components or impurities. The bath is employed in molten condition, usually at a temperature above that of molten aluminum and in the range between 660° and 730° C., typically at about 700° C.

As described hereinabove, bath supplied from reservoir 7 through bath supply passage 30 is electrolyzed in each interelectrode space 19 to produce chlorine on each anode surface 20 and aluminum on each cathode surface 21. Electric current applied between the upper anode 14 and the bottom cathode 16 causes the interdisposed bipolar electrodes 15 to exhibit their bipolar behavior and effect electrolysis within each interelectrode space 19. The electrode current density can conveniently range from about 5 to 15 amperes per square inch, but preferred current density can vary from one particular cell to another and is readily determined by observation.

The chlorine produced at the anode is buoyant in the bath and its movement through the bath may be employed to effect bath circulation. That is, the chlorine rising up along the left side, when viewed in FIG. 1, of the cell creates a bath circulating effect including a sweeping of the bath through the interelectrode spaces 19. This sweeping action sweeps the aluminum produced on each cathode surface through and out of each interelectrode space 19 in the same direction as the bath, toward the left as viewed in FIG. 1, and permits the aluminum to then settle down into the sump 4.

As indicated in U.S. Pat. Nos. 4,179,345 and 4,179,346, the spacing between electrodes and the bath velocity through those spaces can vary from cell to cell and within a given cell. For the type of cell shown in FIG. 1, the lower zones closer to the terminal cathodes 16 may exhibit a lower bath velocity through the interelectrode spaces 19, whereas the higher zones closer to terminal anode 14 may exhibit higher bath flow rates through the interelectrode spaces 19. As also indicated in the patents just mentioned, operation of the cell can be improved by utilizing a wettable type graphite for the cathode electrode surface in regions of relatively low bath flow velocity over the cathode surface. The patents further disclose the use of relatively low graphitizing temperatures to favor achieving wettability characteristics in the graphite. The same patents also indicate that increases spacing betwen opposite anode and cathode surfaces is helpful where lower bath flow velocity rates prevail and hence suggest the use of the wettable graphite cathode surfaces for the low flow or widely spaced electrode zones.

The electrodes, including the bipolar electrodes 15, are comprised of graphite grade carbon, which can be produced from coke derived from coal or petroleum. In the case of petroleum coke, such is typically calcined at a temperature of about 800° to 1600° C. in order to drive off volatile impurities. In making an electrode, the calcined coke is blended with a pitch binder to provide a mixture having a pitch content of about 10 to 30% by weight. This mixture is shaped such as by extrusion to provide a suitable size and configuration for use as an electrode or for cutting into electrodes. A shaped member can be cut to provide two or more electrode block pieces, after which the electrode is baked at about 700° to 1600° C. to drive off volatiles from the pitch binder. The next step usually involves immersing the baked block to impregnate it with liquid pitch to increase the density, after which it is again baked at about 700° to 1600° C. The baking and pitch treatment can be repeated one or more times to further increase the density. Finally, the carbonaceous material is graphitized at a typical temperature of about 2000° to 3100° C.

Most graphite commercially produced contains ash which occurs in the starting petroleum coke raw material present as dirt or other impurities. The constituents of the ash include the oxides of aluminum, silicon, titanium and various trace amounts of calcium, magnesium, potassium and titanium oxides. The most prominent ash constituent in most petroleum coke is iron oxide ($Fe_2O_3$) which is often added intentionally to take up sulfur which is present in the crude oil used in producing the coke. The iron oxide ties up the sulfur and prevents evolution of sulfur dioxide in the baking and other processes used in producing graphite. The amount of ash usually present in graphite produced from petroleum coke and graphitized at relatively low temperatures ranges from a relatively low level of a few tenths of a percent by weight up to 2 to 3% where iron oxide is intentionally added, as described above. However, if the temperature employed in graphitizing is relatively high, the ash content is drastically reduced which is believed to be caused by the ash constituents forming volatile carbides which flash off. Hence, the practice of the invention employs the relatively low graphite temperatures, temperatures of 2400° or 2450° C. being considered maximum and temperatures not exceeding 2300° or 2350° C. being preferred. Of course, the temperature employed must be sufficient to accomplish the desired graphitization and, hence, the minimum graphitizing temperature is around 2000° or a little more, or preferably 2050° C. or more. A temperature of 2100° to 2300° C. is preferred.

As indicated above, the practice of the invention includes controlling the amount of titanium and aluminum oxides present in the ash to improve the cathode wear rate of graphite electrodes. The amount of titanium oxide or aluminum oxide in ash is usually in trace quantities of less than 0.1% of either. In practicing the invention, it is desired to have from 0.2 or 0.3 to 10% aluminum oxide ($Al_2O_3$) or titanium oxide ($TiO_2$) or both aluminum and titanium oxides, the total not to exceed 10%. Achieving these levels of $Al_2O_3$ or $TiO_2$ normally requires adding a significant amount of such oxides which, as just indicated, are normally present in merely trace amounts of 0.1% or less in commercially produced grphite. The percentages just mentioned are by weight and are based on the final graphitized condition. The above-mentioned amounts, 0.2 or 0.3% to 10% $Al_2O_3$ or $TiO_2$, provide about 0.1 or 0.15 to 5% aluminum or about 0.12% or 0.18% to 6% titanium, total not to exceed 6%.

It is preferred in practicing the invention to include relatively pure $TiO_2$ or $Al_2O_3$ such as the normal and ordinary commercially pure grades thereof since such assures a more constant condition in the oxides and provides for better control in producing the graphite electrodes. However, in a broader sense titanium and aluminum oxides can be provided as an alumina containing substance such as bauxite, alumina ores, clay or the like. Further, compounds other than the oxides can be useful such as organic or inorganic compounds of aluminum and titanium provided such remain substantially stable under cell operating conditions including temperature or at least do not react or decompose to produce a residue or reaction product which is detrimental to the operation of the electrolysis cell. Aluminum oxycarbide, titanium carbide or titanium diboride are compounds which might be useful. The compounds of aluminum or titanium should, after graphitization, leave aluminum compounds such as aluminum carbides or oxycarbides or aluminum oxide. The aluminum should not be metallic since the cell is necessarily operated above the melting point of aluminum. The amounts of any compounds used as a source for titanium or aluminum other than their oxides should be such as to provide an equivalent amount of the respective aluminum or titanium as is provided in the recited composition ranges for the metal oxides.

As indicated above, it is important to keep the graphitizing temperature to the low side of the graphitizing range, but it is just as important that graphitization actually be effected. That is, low temperatures such as those commonly used in baking carbonaceous material to provide relatively strong coherent bodies thereof are not necessarily useful in practicing the invention which requires true graphitization rather than mere baking, and it is important to clarify or distinguish between baking and graphitizing as they apply to heating carbonaceous bodies in making graphite electrodes. Baking is normally done by heating a carbonaceous body, either in unitary or particulate form, for the purpose of driving off volatiles, such as components in the pitch used in binding or densifying a carbonaceous body. In the baking process, temperature is gradually increased to allow for the evolution of the volatiles and to permit the shrinkage which occurs in the baking operation to proceed gradually so as to avoid cracking. Baking temperatures normally range from about 700° to about 1000° C. although higher temperatures up to 1600° or higher also can be employed, and the operation can be referred to as baking or sometimes as calcining. Calcining for the most part applies to particulates or raw material, whereas the baking term usually applies to a green compact comprising particulate carbonaceous material and a carbonaceous pitch-type binder wherein baking converts the pitch binder into coke to provide solid bonds with the filler materials. The baking operation is normally carried out in a conventional convection-type furnace heated by gas or oil with the heat input to the carbon being by indirect heat transfer. The entire heating cycle in baking is somewhat time consuming, and can take from a week or two up to a month or more. Baking typically results in substantial shrinkage through loss of volatiles and hence increases density. However, there is no significant change in the carbonaceous internal structure achieved in baking, and the structure continues to appear as amorphous or as containing crystallites of such small size as to make the structure appear or at least behave like an amorphous structure.

Graphitization is readily distinguished from baking in that it is done at somewhat higher temperatures and produces drastic and easily observed changes in the internal structure but without drastic changes in density, as contrasted with baking as just described. In graphitizing, the temperatures employed range from a little over about 2000° or 2050° up to 3000° C., with the more typical temperatures ranging from about 2400° or 2500° C. to 3000° C. as these temperatures are usually associated with the higher quality grades of graphite. This heating occurs over a rather extensive time period typically of about two weeks. The heating is done in a non-oxidizing atmosphere and by passing electric current directly through the graphite so as to heat the graphite internally and directly by its own electrical resistance, with the graphite itself thus providing the electric resistive heating element, as opposed to the more conventional furnace and heating employed in baking. While graphitizing does not drastically change the density of the carbonaceous materials, it drastically alters and rearranges the internal structure, which, after graphitizing, can no longer be considered amorphous. The resulting graphite structure exhibits the well-known graphitic structural arrangement comprising parallel plates or platelets of flat, hexagonal arrays of carbon atoms.

To illustrate some of the differences in internal structure in comparing graphite with carbon, and $d_{002}$ and $L_c$ dimensions are useful. The "c" dimensions applies to the crystal or crystallite size in the "c" direction, the direction normal to the basal plane, and the $d_{002}$ dimension is the interlayer spacing. These dimensions are normally determined by x-ray diffraction techniques. R. E. Franklin defines amorphous carbon having an interlayer spacing ($d_{002}$) of 3.44 Å and crystalline graphite of 3.35 Å. (*Acta Crystallographica,* Vol. 3, p. 107 (1950); *Proceedings of the Royal Society of London,* Vol. A209, p. 196 (1951); *Acta Crystallogrphica,* Vol. 4, p. 253 (1951).) During the process of graphitization, the amorphous structure of carbon is changed to the crystalline structure of graphite which is shown by an increase in the $L_c$ dimension and a decrease in the $d_{002}$ dimension. In carbon, the $L_c$ dimension normally ranges from 10 to about 100 Angstrom units (Å) or a little less, whereas most graphite typically exhibits $L_c$ dimension of greater than 350 or 400 Å, that is typically from over 400 Å to about 1000 Å. There is another substantially graphitic structure wherein $L_c$ is between about 100 Å or a little more up to about 350 or 400 Å or a little less, and this is sometimes referred to as "semi-graphite" having the same general plate-like shape and configurations in its structure as graphite just described but differing some from the more common x-ray diffraction pattern for graphite. Both graphite structures have a $d_{002}$ dimension less than 3.4 Å whereas carbon has a $d_{002}$ dimension greater than 3.4 Å. In general graphitizing at temperatures of about a little over 2000° C. or 2050° C. up to about 2350° C. or 2400° C. tends to produce the "semi-graphite" structure whereas temperatures over 2400° C. tend to produce the "normal" graphite structure.

Another practice in producing carbonaceous electrodes is to employ particulate graphite as the starting material to which the pitch is added and the mixture compacted, impregnated and baked. However, while this baked carbonaceous material contains graphite it is not constituted of graphite as a continuous unitary graphite structure but rather contains instead both graphite particles and amorphous carbon derived from the pitch. In practicing the invention, it is important that the cathode electrode be constituted of a continuous unitary graphite structure by graphitizing after shaping and compacting so as to assure the proper combination of electrical and thermal conductivity, coefficient of expansion and stability properties in the graphite-refractory hard metal composite. This results in the electrode behaving substantially like pure graphite from the standpoint of graphite's desired combination of properties as just mentioned.

Thus, while the invention contemplates the use of relatively low graphitizing temperatures, it is important that graphitization in fact be achieved to impart to the electrode a substantially unitary continuous graphitic structure.

EXAMPLE

Graphite electrodes were produced by compacting particulate coke blended with pitch, baking to drive off the volatiles and thereafter immersing in liquid pitch and more baking to impregnate the compact and increase its density. The impregnation-baking cycle was repeated to further increase the density. Finally the compacts were graphitized at a temperature of 2200° C. One sample was produced as just described and a different sample was produced the same way except that alumina was added in powder form and blended with the coke particulate prior to blending with the pitch to initially form the compact. The amount of alumina added was about 1.2% by weight which provides about 0.6% aluminum. Both samples were tested in an electrolysis cell where the electrolytic bath contained about 70% NaCl and 30% LiCl to which was added about 7% $AlCl_3$. The cell was electrolyzed for about 5 days at about 710° C. and aluminum produced at the cathode surfaces. The wear rate was determined for a measured time and converted to millimeters (mm) of wear per year to provide a comparative wear estimate for the standard sample and for the sample representing the improved practice of the invention. The table below sets forth the significant composition differences between the standard and improved graphite electrode cathode material and the cathode wear rate.

TABLE

| | Standard Sample | Improved Sample |
|---|---|---|
| Residual ash, weight % | 2.0 | 3.01 |
| Iron, weight % | 0.67 | 0.49 |

TABLE-continued

| | Standard Sample | Improved Sample |
|---|---|---|
| Aluminum, weight % | —* | 0.64 |
| Cathode wear rate (mm/yr) | 8.3 | 1.9 |

*parts per million range

From the preceding table it can be seen that the improved graphite cathode containing the aluminum oxide performed much better in exhibiting a very much reduced cathode wear rate over the standard graphite sample.

While the invention has been described in terms of preferred embodiments, the claims appended hereto are intended to encompass all embodiments which fall within the spirit of the invention.

What is claimed is:

1. A method for the production of metal in an electrolytic cell containing a compound of said metal dissolved in a molten solvent bath, the cell including a plurality of interelectrode spaces between opposed anode and graphite cathode electrode surfaces wherein said bath is moved through a plurality of said interelectrode spaces where said bath is electrolyzed to deposit molten metal on said graphite cathode electrode surfaces wherein the improvement comprises providing said graphite at at least one of said cathode surfaces containing an aluminum compound compatible with the operation of the electrolytic cell and stable for retention of said aluminum in said graphite during cell operation, said graphite being provided by graphitizing at a temperature in the range of over 2000° C. up to 2400° C. carbonaceous material containing an aluminum compound containing 0.1 to 5% aluminum thereby to increase the ash content of said graphite above the content which would be achieved without said aluminum.

2. The method according to claim 1 wherein said graphite is graphitized within the range of 2100° to 2300° C.

3. The method according to claim 1 wherein said aluminum compound is aluminum oxide.

4. The method according to claim 1 wherein said metal produced is aluminum.

5. The method according to claim 4 wherein a titanium compound is also present in said graphite.

6. The method according to claim 4 wherein said bath is moved through said interelectrode space at a velocity of 1-½ feet per second or less.

7. The method according to claim 4 wherein said interelectrode space is greater than ½ inch.

8. A method for the production of aluminum in an electrolytic cell containing a compound of said aluminum dissolved in a molten solvent bath, the cell including a plurality of interelectrode spaced between opposed anode and graphite cathode electrode surfaces wherein said bath is moved through a plurality of said interelectrode spaces where said bath is electrolyzed to deposit molten aluminum on said graphite cathode electrode surfaces wherein the improvement comprises providing said graphite at at least one of said cathode surfaces by graphitizing at a temperature in the range of over 2000° C. up to 2400° C. carbonaceous material containing 0.2 to 10% $Al_2O_3$ thereby to increase the ash content of said graphite above the content which would be achieved without said $Al_2O_3$.

9. The method according to claim 8 wherein said graphite is graphitized within the range of 2100° to 2300° C.

10. The method according to claim 8 wherein a titanium compound is also present in said graphite.

11. The method according to claim 10 wherein said bath is moved through said interelectrode space at a velocity of 1-½ feet per second or less.

12. The method according to claim 10 wherein said interelectrode space is greater than ½ inch.

* * * * *

UNITED STATES PATENT AND TRADEMARK OFFICE

CERTIFICATE OF CORRECTION

PATENT NO. : 4,308,113

DATED : December 29, 1981

INVENTOR(S) : Subodh K. Das

It is certified that error appears in the above-identified patent and that said Letters Patent are hereby corrected as shown below:

| | |
|---|---|
| Col. 2, line 43 | After "oppositely", change "acing" to --facing--. |
| Col. 3, line 58 | Before "metal" add --molten--. |
| Col. 3, line 61 | Before "shown", change "now" to --not--. |
| Col. 5, line 12 | After "that", change "increases" to --increased--. |
| Col. 5, line 12 | After "spacing", change "betwen" to --between--. |
| Col. 5, line 54 | After "to", change "2 to 3%" to --2 or 3%--. |
| Col. 6, line 14 | After "produced", change "grphite" to --graphite--. |
| Col. 7, line 47 | After "carbon,", change "and" to --the--. |
| Col. 7, line 48 | Before "applies", change "dimensions" to --dimension--. |

UNITED STATES PATENT AND TRADEMARK OFFICE

CERTIFICATE OF CORRECTION

PATENT NO. : 4,308,113

DATED : December 29, 1981

INVENTOR(S) : Subodh K. Das

It is certified that error appears in the above-identified patent and that said Letters Patent are hereby corrected as shown below:

| | |
|---|---|
| Col. 7, line 57 | After "Acta", change "Crystallogrphica" to --Crystallographica--. |
| Col. 10, line 18<br>Claim 8, line 4 | After "interelectrode", change "spaced" to --spaces--. |

Signed and Sealed this

*Fifteenth* Day of *June 1982*

[SEAL]

*Attest:*

GERALD J. MOSSINGHOFF

*Attesting Officer*

*Commissioner of Patents and Trademarks*